US008205569B2

(12) United States Patent
Francis

(10) Patent No.: US 8,205,569 B2
(45) Date of Patent: Jun. 26, 2012

(54) ANCHOR

(76) Inventor: Rex William Francis, Avonsleigh (AU)

( * ) Notice: Subject to any disclaimer, the term of this patent is extended or adjusted under 35 U.S.C. 154(b) by 231 days.

(21) Appl. No.: 12/532,889

(22) PCT Filed: Mar. 27, 2008

(86) PCT No.: PCT/AU2008/000440

§ 371 (c)(1),
(2), (4) Date: Sep. 24, 2009

(87) PCT Pub. No.: WO2008/116272

PCT Pub. Date: Oct. 2, 2008

(65) Prior Publication Data

US 2010/0058968 A1 Mar. 11, 2010

(30) Foreign Application Priority Data

Mar. 27, 2007 (AU) ..... 2007901627

(51) Int. Cl.
*B63B 21/24* (2006.01)
*B63B 21/32* (2006.01)
*B63B 21/34* (2006.01)

(52) U.S. Cl. ..... 114/294; 114/301

(58) Field of Classification Search ..... 114/301, 114/294, 305, 296, 299, 295, 302
See application file for complete search history.

(56) References Cited

U.S. PATENT DOCUMENTS 4,029,040 A * 6/1977 Klaren ..... 114/304
4,869,193 A * 9/1989 van den Haak ..... 114/294
5,138,967 A * 8/1992 McCarron et al. ..... 114/301
5,188,055 A * 2/1993 Kershner ..... 114/299
5,855,181 A * 1/1999 Oxford ..... 114/301
5,970,902 A * 10/1999 Francis ..... 114/301
6,148,758 A * 11/2000 Wilkins ..... 114/301
6,332,423 B1 12/2001 Petersen
6,390,011 B1 5/2002 Goodman
7,111,576 B2 * 9/2006 Francis ..... 114/301
7,171,917 B2 * 2/2007 Poiraud ..... 114/301
D556,666 S * 12/2007 Mair ..... D12/215

FOREIGN PATENT DOCUMENTS

EP 1279590 B1 5/2005
WO WO 89/09722 A1 10/1989

OTHER PUBLICATIONS

International Search Report for PCT/AU2008/000440 dated Jun. 30, 2008.
Written Opinion of the International Searching Authority for PCT/AU2008/000440 dated Jun. 30, 2008.
Written Examination Report dated Mar. 7, 2011 from the New Zealand Intellectual Property Office for the National Phase of the International Patent Application No. PCT/AU2008/000440 dated Jun. 30, 2008.

* cited by examiner

*Primary Examiner* — Stephen Avila
*Assistant Examiner* — Anthony Wiest
(74) *Attorney, Agent, or Firm* — Cook Alex Ltd.

(57) ABSTRACT

An anchor includes a base member (10), having a leading end or toe (26), associated therewith, the base member (10) being formed from opposed, interconnected substantially triangular shaped flukes (20, 30), and a shank member (100) extending upwardly therefrom and attached thereto. The lateral and rear free edge of each fluke (20, 30) have extensions (22, 32 and 23, 33) associated therewith and depending angularly therefrom. All free edges of the anchor are other than blunt. The base member (10) includes one or more apertures, slots or discontinuing extending therethrough.

11 Claims, 4 Drawing Sheets

100
110
130
140
33
34
25
30
40
26
4
4

110
25
23
22
32
33

40
30
20

ANCHOR

FIELD OF INVENTION

The present invention relates, in general terms, to improvements in anchors or means for anchoring. More particularly, but not exclusively, the invention relates to an improved form of anchor which is responsible for enhanced holding power and is suited for use in a variety of different contexts, in effect regardless of the nature of the holding, and which at the same time facilitates or allows for ready release and/or re-setting of the anchor as and when desired.

Throughout the ensuing specification particular reference will be made to an especially preferred embodiment or context of usage of an anchor in accordance with the present invention, in the form of a marine anchor to be actually employed for purposes of anchoring a boat or the like water-borne vessel at any given locale. An anchor in accordance with the present invention is especially suited for use with or in what are nowadays referred to as super yachts, maxis or super maxis. However, the present invention is not to be considered to be limited to such use. In fact, anchors in accordance with the invention will be equally usable on any water-borne vessel or vehicle.

It should be understood that the anchor in accordance with the present invention is equally effective regardless of the type of holding, whether that holding be sand, rock, coral, mud or the like. It should be realized further that an anchor in accordance with the present invention is also equally suited for purposes other than the mooring of boats, as for example permanent or temporary mooring of buoys, drilling rigs and/or the like.

BACKGROUND OF THE INVENTION

There is a need to anchor or moor boats, buoys, drilling rigs and any other form of water-craft, either permanently or temporarily, in a given position. Such need gives rise to problems by virtue of the fact that, dependent upon circumstances and location, it may become necessary to anchor or moor such craft in different types of holdings. In the past it has been found that an anchor which might be particularly suitable for use in one type or form of holding, as for example sand or mud, may not be as appropriate for another or different type of holding, as for example rock or coral. In accordance with the known art, therefore, it has been a practice to utilize a different form of anchor dependent upon the nature of the holding. There has previously not been available a multi-use, multi-purpose anchor.

In the result, then in order to achieve the best or optimum anchoring effect a different form of anchor would need to be employed dependent upon the nature of the holding. That requirement gave rise to problems, regardless of the size of the water-borne craft or the like to be anchored. For obvious reasons it would not be particularly efficient or practical to have a craft operator need to change the type of anchor being used dependent upon circumstances and the nature of the holding below the craft.

Again in accordance with the known art there has been a tendency for conventional anchors, if disturbed, to roll over and thereafter be disposed on the ocean/sea/river/lake bottom (or holding) incorrectly, in effect the wrong way up. Prior art anchors, when so disturbed, would tend to lay on their side and remain that way. Clearly when in such a configuration the efficiency of operation of the overall anchor can be expected to be seriously reduced. Furthermore, when in such a configuration there will be a tendency for the anchor to be dragged across the holding, giving rise to disturbance of sand, mud, dislodgment of rock, destruction of coral etc. Such can have a deleterious effect on the overall environment and, if the relevant craft is being used, for example, for purposes of angling or fishing, such a disturbance to the holding/ocean bottom is again undesirable.

Another problem/disadvantage associated with anchors in accordance with the known art has related to the tendency or possibility of such anchors inadvertently working their way free from the holding, regardless of the nature of such holding. Once an anchor works itself free from its holding then the vessel or craft associated therewith will thereafter be totally susceptible to the vagaries of the tides, weather, etc. This can be especially unfortunate if, for example, the crew or passenger(s) of a vessel or craft are not aware of the fact that the anchor has worked loose, as for example if they are sleeping or otherwise occupied. An unanchored vessel can drift alarmingly, dependent upon the tides and the prevailing weather conditions, leaving itself liable to beaching, being swept onto rocks or reefs, etc. In other words, one consequence of an anchor working itself free from its holding can involve significant danger to the occupants of the vessel or craft.

Anchors of this general type usually comprise, as major components, a base member made up of one or more flukes and a shank associated therewith. Generally speaking the base member or each fluke is in the form of a substantially flat, planar member having a large surface area. The base member includes a leading end, generally pointed or other than blunt, the intention being to have that leading end penetrate the holding. When such an anchor is totally embedded in the relevant holding, the pressure exerted by the material of such holding on the base member represents a major component of the holding power of the overall anchor.

In accordance with known practices the base member or each fluke of such an anchor may be formed from a metal plate (or the equivalent), and may also include a number of external ribs for increased stiffness or strength. The shank may be in the form of an elongate member which is attached, either fixedly or movably, adjacent the stern of the base member, the shank including, at the other free end thereof, means allowing for connection thereof to a mooring line, cable, chain or the like. Generally speaking the shank will be substantially coincident with a central longitudinal axis of the base member when the anchor is viewed from above. The function of the shank is to transmit force between the base member and the mooring line, chain or cable.

In general terms there can be said to exist two broad categories or types of anchors. The first category includes traditional or so-called swing shank anchors, which anchors include shanks which are substantially straight and will be rotatably secured to one or more flukes or to a base member, to allow the shank to pivot at least to a limited degree on either side of each fluke or the base member. With such an anchor, as the anchor itself is dragged along the sea floor or holding, one side of the base member or each fluke thereof will face downwardly, in other words towards the sea floor or holding. Once the leading end of the base member or each fluke thereof actually penetrates the holding, the shank may then swing to the alternate side. For such anchors, since either side of the base member or each fluke thereof can be facing in a downwards direction, the base member or each fluke thereof will be substantially symmetrical in shape.

A second category of anchors of this general type includes the modern or so-called fixed shank type of anchor. Therein each fluke, or the base member, has a defined top surface and underside, this by reason of the fact that the attitude of the shank itself is fixed relative to each fluke during operation, as distinct from being rotatable as with the aforementioned traditional type anchors. In such modern anchors the shank extends upwardly from the top surface of each fluke or the base member. In order to be able to penetrate the holding, anchors of this type must land on the sea floor or holding with each fluke or the base member sited underneath the shank and with the bottom side of each fluke or the base member itself resting on the surface of the sea floor or holding.

Regardless of which type of anchor is being employed, an important parameter for measuring performance is the holding efficiency, or the ratio of the holding power to the weight of the anchor itself. By reason of the fluke symmetry of traditional or swing shank type anchors, additional weight needs to be added to the overall anchor itself, thereby reducing holding efficiency. Fixed shank anchors, on the other hand, eliminate some of the redundant structure associated with traditional or swing-type anchors.

A drawback associated with prior art anchors has been an inherent poor control of roll and yaw instability, both before and after the anchor has fully penetrated the holding. Yaw, by definition, is the rotation of an anchor about an axis which is normal to the top surface of the fluke, whilst roll is defined as rotation about the central longitudinal axis of the fluke or base member itself. The majority of prior art anchors have had their shanks attached at or in the vicinity of the rear or stern of each fluke or the base member, at a location which is far behind the pressure centre of each fluke or the base member itself. In that regard the "pressure centre" is intended to refer to the point on the top surface of each fluke or the base member through which the resultant force due to soil pressure passes. By reason of the relative location of the pressure centre and the shank attachment point (to each fluke or the base member), the shank will be effectively pushing each fluke or the base member in a forward direction, thereby creating a degree of instability.

When the leading end of each fluke or the base member encounters any form of uneven loading, then the anchor will yaw. In that regard it should be understood that the forces acting on the leading end of an anchor which cause yaw will also cause rolling of that same anchor. As the anchor yaws, the shank becomes angled relative to the mooring line. When the yawing force acting on the leading end of each fluke or the base member is coupled with the component of the mooring line force on the shank itself, a roll moment is created.

The present invention seeks to overcome the problems and disadvantages associated with the prior art by providing an improved form of anchor which is light-weight when compared with prior art arrangements), efficient in its operation in terms of holding efficiency, adjustable for use in different holding conditions, allows for easy initial penetration of the holding, stabilizes against yaw and roll and is also environmentally friendly.

In accordance with the present invention, therefore, there is provided an improved anchor including: a base member, one end thereof constituting a leading end of said anchor and being adapted to assist in anchorage/embedding of said anchor within a given holding; and a shank member fixedly attached to said base member, said shank member being adapted, in use, to receive and releasably retain at least one anchor line, rope or cable, wherein said base member is of a delta shape or configuration when viewed in plan and with a vortex of said delta shape constituting said leading end of said anchor, and wherein said base member includes opposed respective first and second flukes, each of said flukes being substantially triangular in shape when viewed in plan, said opposed flukes being disposed at an angle to one another and being joined along a line which constitutes a central longitudinal axis for said base member, wherein each free edge of each fluke is other than blunt whereby to constitute a cutting, digging or scraping means for embedding said anchor.

DESCRIPTION OF THE DRAWINGS

In order that the invention may be more clearly understood and put into practical effect, reference will now be made to a preferred embodiment of an improved anchor in accordance with the present invention. The ensuing description is given by way of non-limitative example only and is with reference to the accompanying drawings, wherein.

DESCRIPTION OF PREFERRED EMBODIMENTS

Figure 1A:
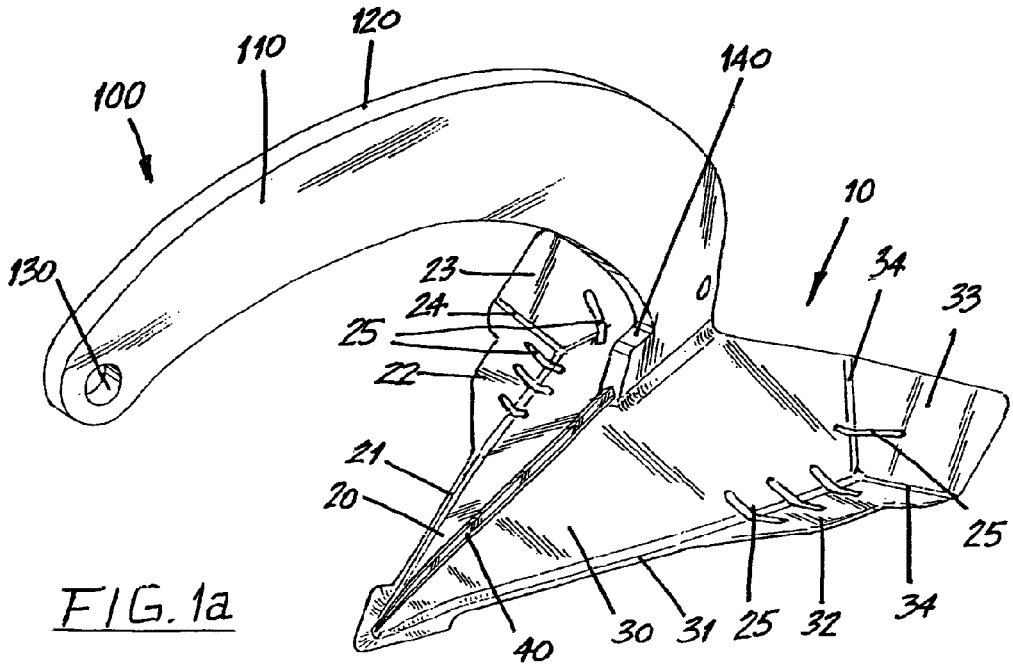
FIG. 1 *a* is a top perspective view of a preferred embodiment of an anchor in accordance with the present invention.
FIG. 1*b* is a bottom perspective view of the embodiment of FIG. 1*a;*
FIG. 1*c* is a side perspective view of the embodiment of FIG. 1*a* and 1*b;*

Turning now to the drawings, as illustrated an anchor in accordance with a preferred embodiment of the invention includes two principal components, namely a base member generally designated 10 and a shank member generally designated 100. In the especially preferred embodiment shown the base member 10 will be of a substantially unitary construction, with the shank member 100 being adapted to be affixed thereto in any known manner and using any known method and/or means. Preferably the principal components of the overall anchor will be fabricated from metal plate or base metal and joined together as by welding. It should be understood, however, that the material of construction, the method of construction and the means employed for affixing the shank member 100 relative to the base member 10 do not constitute part of the invention.

Again in the preferred embodiment illustrated the base member 10 is comprised of opposed flukes 20 and 30. The overall base member 10 is of a substantially triangular or delta shape when viewed in plan, with a vertex thereof constituting a leading end for said anchor which is adapted to assist in bedding in of said anchor in any given holding. Each of the flukes 20,30 making up the overall base member 10 is preferably of a substantial triangular shape when viewed in plan, with the opposed flukes 20,30 meeting one another at an angle along a line 40 which constitutes a centreline for said anchor. The opposed flukes 20,30 are disposed at an angle one to the other such that, when viewed in end elevation, the base member 10 of said anchor has a substantial inverted V shape.

Each fluke 20,30 is made up of a principal and substantially planar portion which extends lengthwise of the overall anchor/base member 10. Extending along and from at least a part of the exposed free edges 21, 31 of said flukes 20, 30, and protruding at an angle to both said edges 21,31 and said principal planar portion of said flukes 20,30, are lateral extensions 22,32, with further rear extensions 23,33 projecting at an angle from the rear edge of each fluke 20,30, with the respective lateral and rear extensions 21,22,31,32 being joined along common edges 24,34. In the especially preferred embodiment shown the overall base member 10, made up of the two flukes 20,30, will be of a substantially unitary construction formed in any suitable manner and using any suitable means. Each fluke 20,30 will include a plurality of slots, apertures or discontinuities 25 extending therethrough. In an especially preferred embodiment such slots, apertures or discontinuities 25 may be formed by laser cutting of the metal plate making up the base member 10. Once again, however, it should be understood that the number and shape or size of such slots, apertures or discontinuities 25 formed in each fluke 20,30, the physical location thereof and the method of formation thereof are not of the essence of the invention. Indeed, in accordance with the invention such slots, apertures or discontinuities 25, of any size and shape, may be located in the principal planar portions of the flukes 20,30, and/or in the lateral extensions 22,32, and/or in the rear extensions 23,33, or in fact in any and all thereof.

Figure 1B:
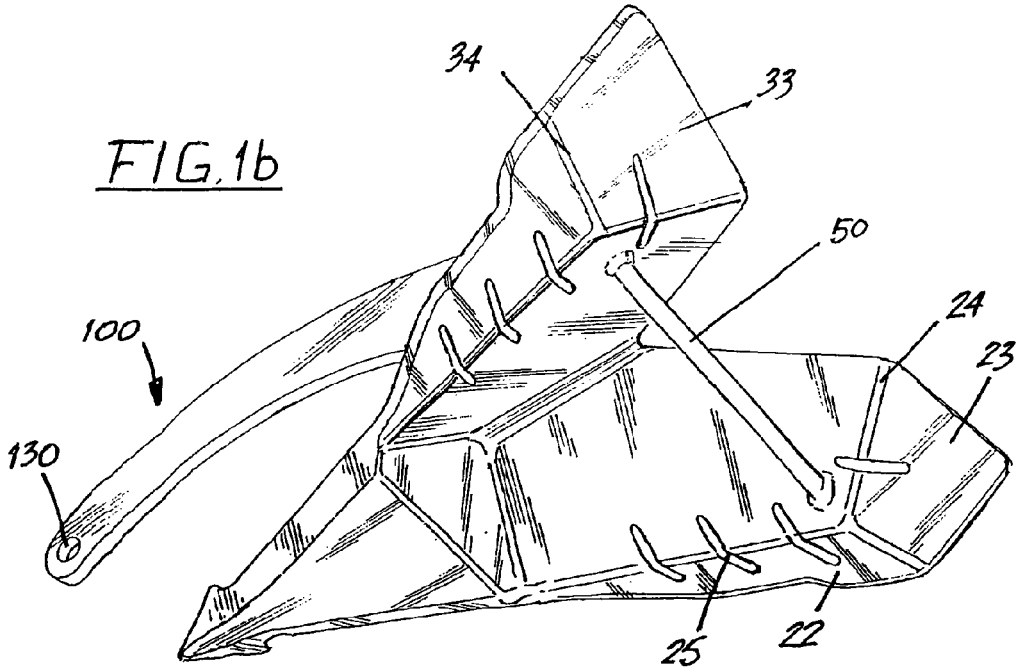
Figure 1C:
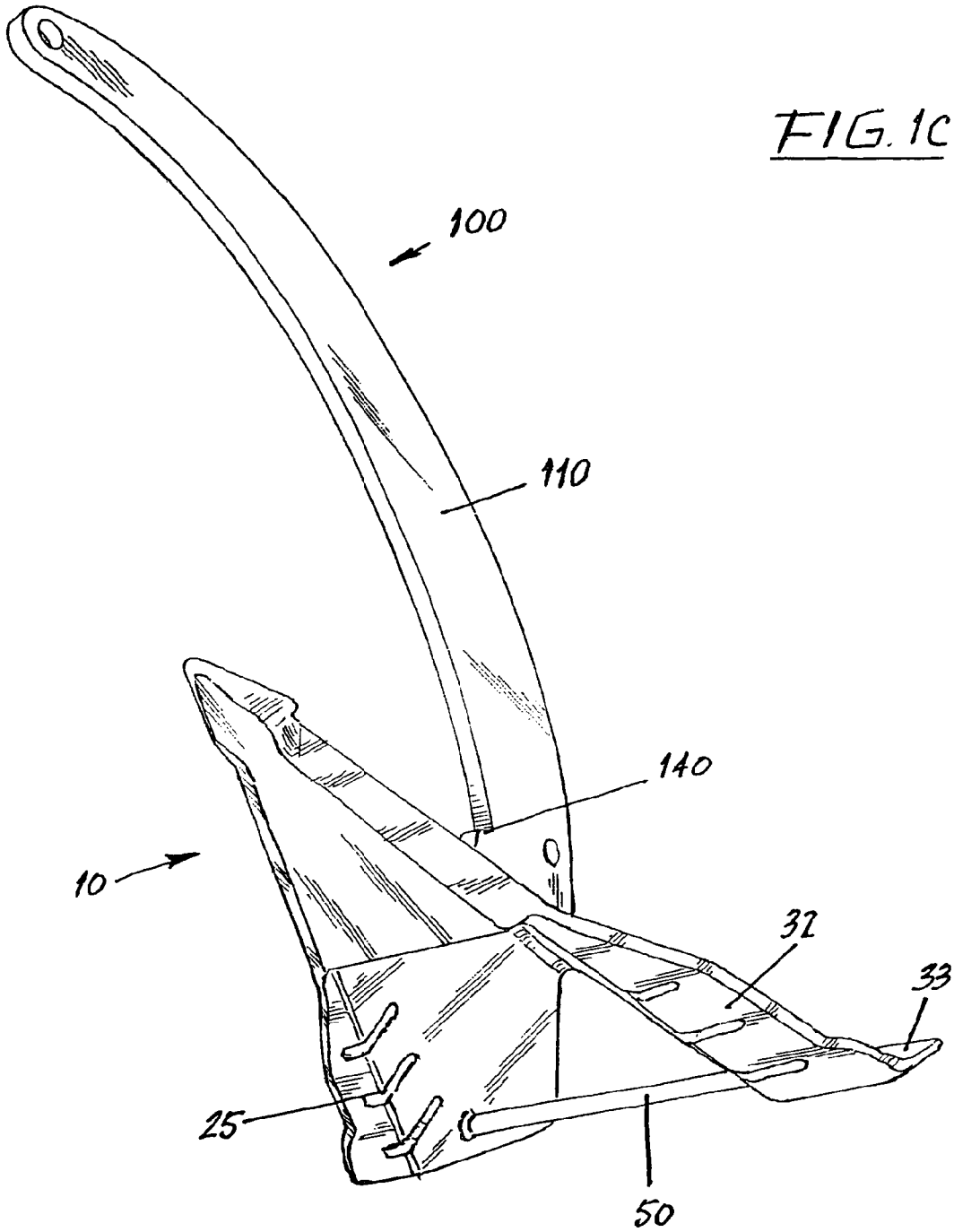
Figures 2, 3, 4:
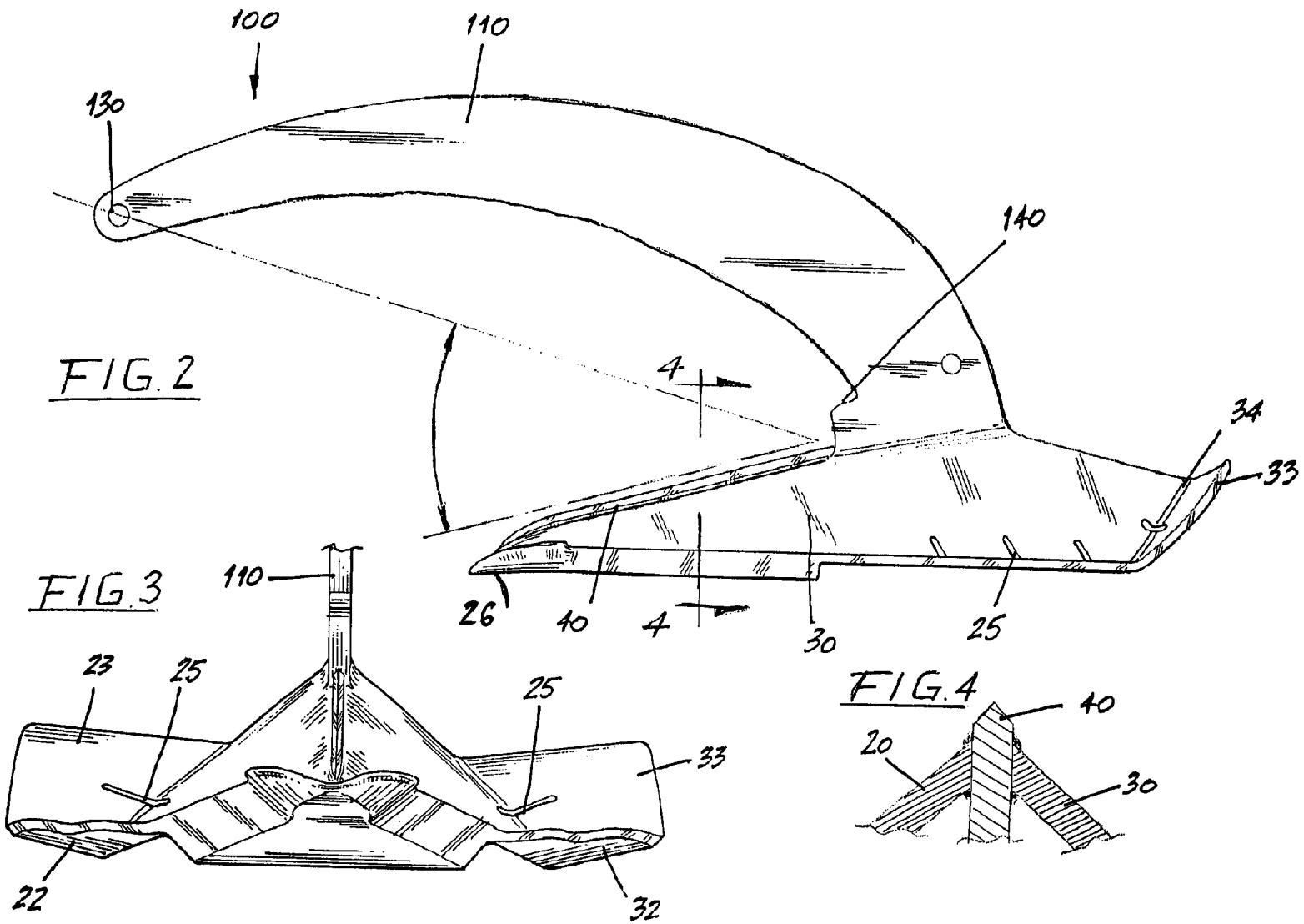
FIG. 2 is a side view of the anchor of FIGS. 1*a*, 1*b* and 1*c;*
FIG. 3 is a front end view of an anchor in accordance with the embodiment of FIG. 1*a;*
FIG. 4 is a sectional view taken along the line 4-4 in FIG. 2.
Figure 5:
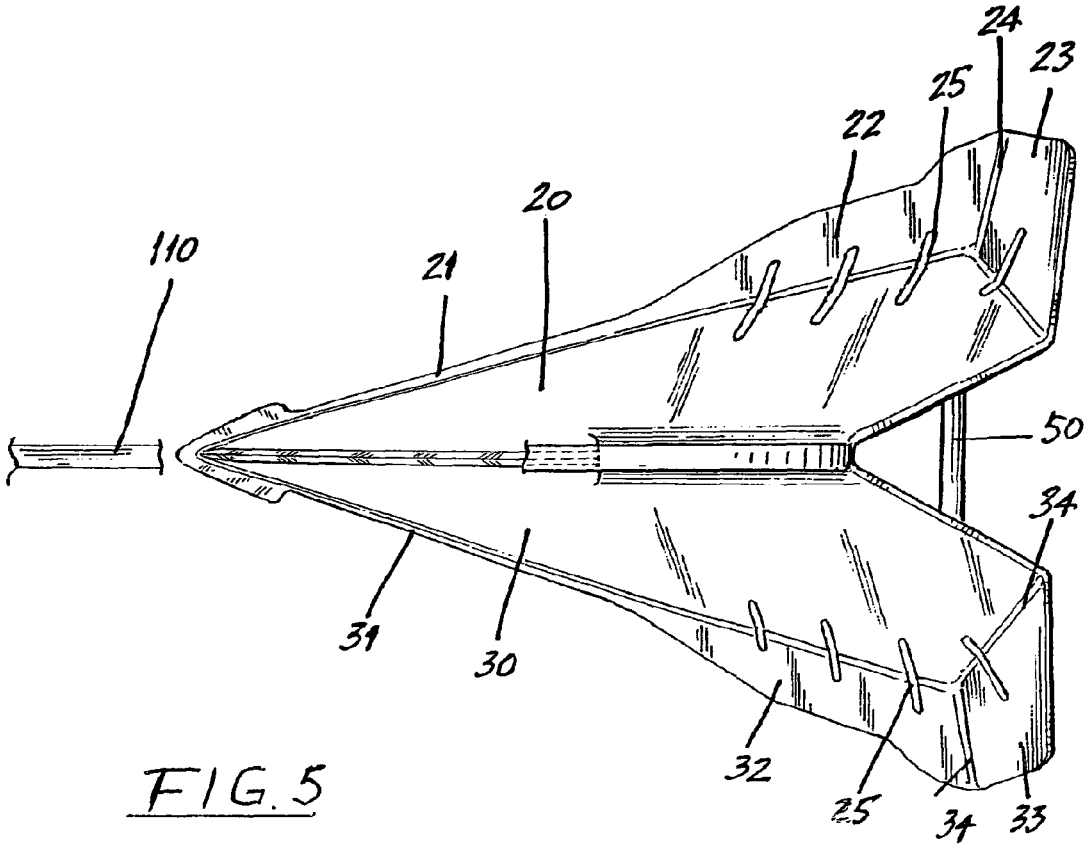
FIG. 5 is a top plan view of a preferred embodiment of an anchor in accordance with the present invention.
Figure 6:
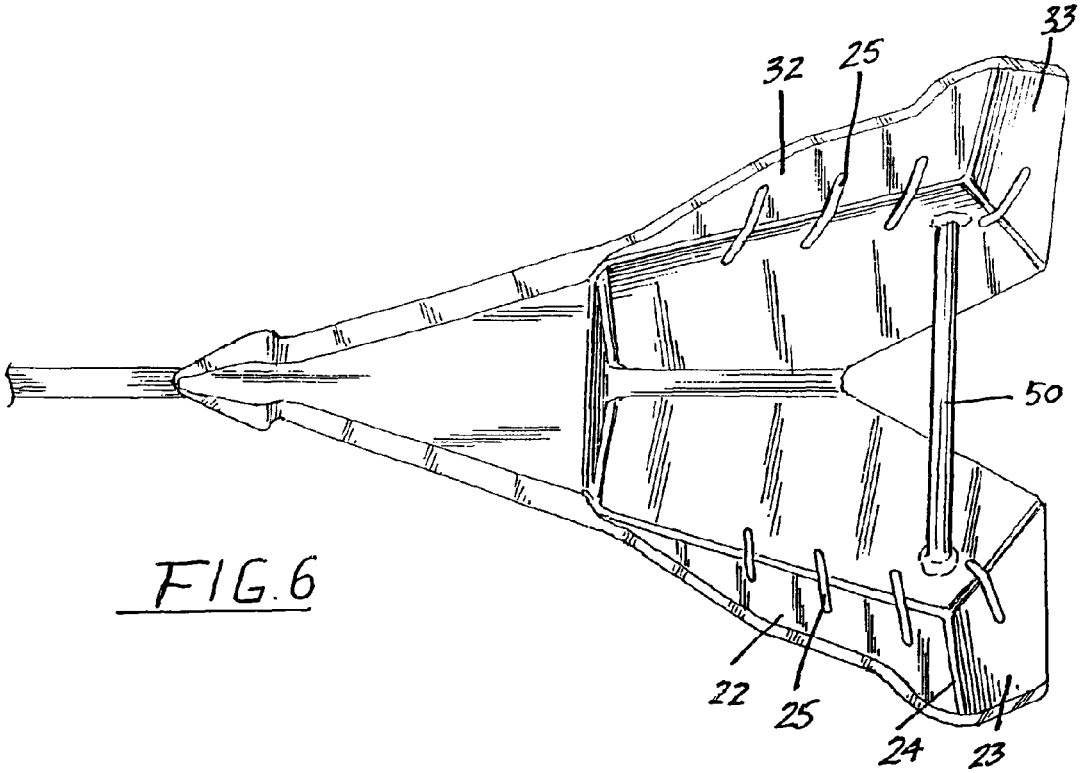
FIG. 6 is a bottom plan view of a preferred embodiment of an anchor in accordance with the present invention.

With particular reference now to FIGS. 1*a*, 1*b* and 2 it should be noted/understood that, at the toe end of the base member 10, there is provided a turned down or stepped-down leading end or edge, generally designated 26. In essence each of the opposed flukes 20,30, as shown more clearly in FIG. 2, has a down-turned leading end. In practical terms such means that, in use, the penetrating effect of the overall anchor is enhanced, with the weight of that overall anchor being concentrated at that leading end 26 for purposes of penetration of any given holding.

Insofar as the base member 10 itself is concerned, in accordance with a preferred embodiment each free edge thereof will be other than blunt, thereby constituting a scraping, cutting or digging surface or means for the overall anchor. This significantly enhances the ease of penetration of an anchor in accordance with the present invention, when compared with the prior art anchors.

As shown more clearly in FIG. 1*b*, a spreader bar 50 extends between the respective flukes 20,30, to add extra strength to the overall anchor.

Insofar as the shank 100 is concerned, such preferably includes an arm portion 110, extending relatively upwardly from, and substantially normally to, the base member 10. That arm portion 110 is preferably of a continuously reducing width dimension along the length thereof, with the uppermost edge 120 thereof being of a substantially arcuate configuration, with there being no flattened or straight sections along the length thereof. At or in the vicinity of the free end of the arm portion 110 there will be provided means, as for example a through-bore or aperture 130, for receiving and releasably retaining a chain, cable or rope for/of said anchor (not shown).

At a location spaced from the site of connection of the shank member 100 to said base member 10, along the length dimension of said arm portion 110, there will be provided at least one shoulder 140 (for a reason to be explained hereinafter).

The arrangement the subject of the present invention, as described and illustrated, exhibits a number of advantages when compared with the prior art. The principle of operation of the anchor, the nature of the advantages attributable thereto, and the reasons therefor, should be evident from the following explanations.

In terms of penetration of a given holding, such is dictated by a parameter which shall hereinafter be referred to as resistance. The present invention seeks to provide an anchor which exhibits greater penetration regardless of the nature of the holding. This is achieved by having substantially all free edges of the flukes 20,30, as well as the extensions 22,23,32 and 33 being capable of a cutting, scraping or digging action. All such free edges are shaped to be other than blunt. The fact that the free edges are other than blunt—in other words sharpened or come to a point—gives rise to a chiselling effect, which allows ready and rapid entry into/penetration of any type of holding or substrate.

Insofar as the shank member 100 is concerned, the fact that such is in the form of a substantially arcuate member having a decreasing width dimension along the length thereof means that, if the anchor is in a rolled-over position, there will be effective point contact with the surface of the holding, rather than line contact as would be the case with anchors with conventional shank members. Such assists in encouraging an overturned anchor to right itself or assume its correct position. In a practical sense, even if to all intents and purposes no weight or load is imposed on the toe or leading end 26 of the overall anchor, the anchor will still roll over. In engineering terms the radiused/shaped shank member 100 has its effective centre of gravity disposed closer to the base member 10, this when compared with the prior art arrangements. Such a radiused/shaped shank member 100 also exhibits less weight when compared with its equivalent conventional anchor. In essence the use of the radiused/shaped shank member 100 means that the overall anchor does not rely on the actual weight of the shank member 100 to ensure rolling. Furthermore, and again when compared with more conventional anchors, with the present applicant's arrangement it is possible to lower the throat opening—by definition the angle subtended by the plane of the shank member 100 and the centreline of the base member 10—this giving rise to an improved capacity for bedding in, even where a hard bottom or holding is involved.

The step or shoulder 140 provided in the shank member 100 serves as a roller stop, to prevent the anchor from hitting its associated boat when winched in or onto a bowsprit or the like.

The rear extension or negative portion 23,33 of each fluke 20,30 further assists in bedding in of the anchor, the effect being that the overall weight of the anchor, or more correctly the tail of the anchor, is of little significance in terms of righting an up-turned anchor.

The capacity for utilizing a reduced throat opening or angle means that, in practical terms, more force is capable of being applied through the toe or leading end 26 of the anchor, whereby to allow the anchor to more easily penetrate even harder materials, this again in marked contrast to prior art anchor arrangements with conventional shank members, which suffer from a disadvantage in terms of decreased efficiency of embedment when the holding is formed from harder materials.

It has also been found that the configuration of the present anchor can prevent stalling. The throat opening or throat angle has been found to have an influence on the rate of ascent/descent of an anchor. With a plough anchor, for example, if the toe or leading end strikes something harsh—in the holding—the angle of descent will become steeper. With an anchor in accordance with the present invention, since a reduced throat opening or angle is possible there can be exercised greater control over the angle of descent.

The anchor in accordance with the present invention, with its substantially arcuate shank member 100 and flukes 20,30 with extensions 22,23,32 and 33, exhibits a unique geometry. When compared with prior art anchors, with the present applicant's anchor the working relationship between the overall shape/geometry and the front or leading end 26 is not as significant or important. The present applicant's anchor is not as reliant on toe weight to ensure righting from a rolled-over position. Furthermore, the arcuate shape exhibited by the shank member 100 is in itself responsible for imparting enhanced strength capabilities thereto.

The relationship between the rear (negative) extensions 23,33 and the overall flukes 20,30 is such that, even if the flukes 20,30 are of a lesser weight than the shank member 100, correct orientation of that shank member 100 will still occur.

With the present anchor, as it further penetrates the relevant holding a compression of material against the flukes 20,30 begins to occur. The apertures 25 in fact function to reduce resistance, allowing water to be sucked therethrough. That in turn acts to prevent or reduce the possibility of mud or the like material compacting, in fact allowing such mud or the like material to slide off the overall anchor, assisting in further driving in or penetration of the overall anchor. As the anchor penetrates or digs into the holding, the mud or the like being removed slides over the surface of the flukes 20,30, and water is sucked through the apertures 25. Compressive forces generated assist in movement of mud and other material. If the apertures were not present, there would be a tendency for mud and the like to be compressed against the flukes 20,30, thereby creating a degree of resistance, which would in turn act to inhibit further penetration. The compression of the substrate (holding) is increased, with the extensions 22,23, 32,33 being responsible for further pulling or drafting of the loosened substrate to the rear of the overall anchor.

The rear extensions 23,33—also to be referred to as negative flukes—have a significant effect on penetration. This creates what can be referred to as a compression lock, which favours the rate of descent and extent of penetration. The shaped rear end of each fluke 20,30 functions to further compress any substrate or material in a relative upward direction, herein further enhancing the extent of penetration. It has been found that the very existence of these rear extensions 23,33, let alone their actual configuration, acts to prevent the anchor from ploughing. In that regard it should be understood that, with a plough anchor—material is pushed outwardly and upwardly from about that region/location on the overall anchor where the shank member is attached to/with the base member or fluke. In contrast thereto, with an anchor in accordance with the present invention such compression takes place at the very rear of the anchor. This lack of ploughing effect is extremely useful in terms of avoiding/minimizing unwanted description of or damage to any given holding.

The apertures 25, which may be provided in the principal planar portion of each fluke 20,30, as well as in the respective lateral and rear extensions 22,23,32 and 33, allow movement of water therethrough, thereby reducing friction/resistance and at the same time the flow of water seems to substantially prevent mud or other loose material from adhering to the surface of the flukes 20,30.

When the anchor is in the configuration of resting on its shank member 100, then with the leading end or toe 26 in contact with the holding or substrate the negative fluke portion 23,33 of each fluke 20,30 allows for a build-up of loose material, which in turn means more pressure or load will be applied to the toe or leading end 26, again further enhancing penetration.

The anchor in accordance with the present invention, with its convex base member—made up of flukes 20,30 and lateral and rear extensions 22,32,23,33, and with all free edges constituting potential cutting or digging surfaces, exhibits tremendous/enhanced holding power, especially in holding comprising loose material.

By virtue of the fact that the flukes 20,30, lateral extensions 22,32 and rear extensions 23,33 are in different planes, the overall anchor exhibits greater penetration ability, even with holdings of a hard material.

The secondary flukes or lateral extensions 22,32, by being preferably of a substantially concave rather than convex shape—as distinct from the base member—exhibit less resistance to penetration, further enhancing the effectiveness of the overall anchor.

The rear extensions—or negative flukes 23,33—create compressive loads, in the result limiting the extent of travel of the overall anchor in a given holding. This means that the anchor cannot penetrate so deeply as to make release difficult, if not impossible. Further, and by reason of the fact that the rear extensions 23,33 project outwardly from/to the rear of the anchor, they assist in building up of pressure/load to drive the toe or leading end 26 of the anchor more easily into the holding.

Preferably the leading end, toe or breaker head 26 of the present anchor is of a substantially convex shape, further enhancing the cutting effect.

The substantially convex shape of the base member extends well beyond the breaker head or leading end or toe 26 to the rear of the anchor. The respective lateral and rear extensions 22, 32, 23, 33 give rise to a concave shape, functioning to force material being separated from the holding in a rearward direction, to enhance overall holding power. In fact, enhanced compressive forces due to the unique geometry of the base member 10 produce unrivalled holding power—when compared with the prior art—once an anchor has buried itself.

The anchor is further designed for side entry, when it is for example lying on its side, which may sometimes be the ease. The shape and location of the lateral and rear extensions (flukes) 22, 32, 23, 33 not only prevent the anchor from turning over on its back, but also gives rise to significant drag at the extreme rear end/edge. This drag imparts greater pressure/load on the breaker head/toe 26, encouraging further penetration. This is especially important when the holding is formed from harder material.

It should be understood that what are commonly referred to—in the industry—as delta-type anchors have enjoyed usage for a significant period of time. Such known delta-type anchors have been found to suffer from a potentially serious drawback, more specifically a tendency to impact on or hit the hull of the boat when being drawn in, giving rise to unwanted damage. In contrast thereto the anchor in accordance with the present invention, being of a lower trajectory when compared with the prior art, can in no way impact on the boat.

In accordance with an especially preferred embodiment, not shown, an anchor in accordance with the present invention further includes means to assist in re-setting of the anchor, as and if necessary. The shank member 100 includes a shaped slot extending longitudinally thereof, such slot being adapted to receive, and preferably releasably retain, a shackle or the like means, as for example a D-shackle. In use, the anchor in accordance with the present invention is intended to be embedded in the relevant holding. In the instance, however, of the anchor 1 becoming disengaged from its holding, then the D-shackle will act to run along the slot from one end to the other, until such time as it impacts with the end thereof. In that regard it should be understood that, whilst this procedure of course occupies a finite time, in real terms the D-shackle impacts with the end of the slot with quite a substantial force.

The anchor in accordance with the present invention, with its extended cutting or side edges when compared with a conventional anchor, is especially suited for use in holdings which involve or include weeds or the like. The extended cutting edges, as provided by the extensions 22, 23, 32 and 33, allow for improved cutting through weed, kelp or the like. In that regard it should be understood that, when viewed from the toe end 26, for example, the cutting edges or surfaces provided by the associated flanges 20, 30 and extensions 22, 32 are substantially concave from front to back (toe end to rear) of the overall anchor.

Prior art anchors traditionally include a weighted tip, such being achieved by either the use of lead or the like, with the degree of extra weighting being varied dependent on the size of the overall anchor, and also on its intended use. In contrast thereto, no additional weighting is required with the anchor in accordance with the present invention. The relationship (geometric and physical) existing between the negative flukes 23, 33 and the arcuate shank member 100 reduces the need for additional weighting when compared with, for example, prior art delta-type anchors.

In an especially preferred embodiment the base member and shank member of the anchor of the present invention will be of substantially the same weight. There should be no need for the tip or leading end of the anchor, or the overall anchor itself, to utilize or need any form of additional weighting. That said, the anchor in accordance with the present invention has been found to bed-in, dig in or penetrate any holding much quicker, easier and better (meaning deeper) than conventional anchors in accordance with the known art. Such is due to the particular geometry/configuration of the present anchor, and in particular the lateral and rear extensions provided on or to the base members.

The secondary flukes or extensions subtend a slightly negative angle, pointing inwardly towards the anchor rather than outwardly and away from the anchor. Compression of material making up the holding takes place behind these flukes or extensions. An anchor in accordance with the invention relies on a tunneling anchor, rather than the ploughing action attributable to conventional anchors. This in turn means less disruption to the holding, an extremely desirable result for the environment.

Conventional anchors, and more particularly plough-type anchors, in practical terms are best suited for use in what might be referred to as softer holdings. The harder the holding, the more difficulty a plough anchor will exhibit in terms of ease, speed and depth of penetration. In contrast thereto, the present anchor is equally usable in any type of holding.

The existence of the lateral and rear extensions on the base of the present anchor, and the shape and configuration thereof, means that the overall anchor is loaded from the rear, with greater pressure/load therefrom to be imparted to the tip or leading end.

Finally, it is to be understood that the foregoing description refers merely to preferred embodiments of the invention, and that variations and modifications will be possible thereto without departing from the spirit and scope of the invention, the ambit of which is to be determined from the following claims.

The invention claimed is:

1. An improved anchor including:

a base member, one end thereof constituting a leading end of said anchor and being adapted to assist in anchorage/embedding of said anchor within a given holding and another end thereof constituting a rear end of the anchor; and a shank member fixedly attached to said base member, said shank member being adapted, in use, to receive and releasably retain at least one anchor line, rope or cable, wherein said base member is of a substantial delta shape or configuration when viewed in plan and with a vortex of said delta shape constituting said leading end of said anchor, and wherein said base member includes opposed respective first and second flukes, each of said flukes being substantially triangular in shape when viewed in plan, said opposed flukes being disposed at an angle to one another and being joined along a line which constitutes a central longitudinal axis for said base member, wherein each free edge of each fluke is other than blunt whereby to constitute a cutting, digging or scraping means for assisting with embedding said anchor, wherein each of said first and second flukes is of substantially planar shape from a leading end to a substantially planar rear extension that protrudes from a rear edge of said fluke at an angle thereto and out of the plane thereof toward a top surface of the said fluke, said rear extension extending to the rear of the anchor, the base member including at least one discontinuity, hole, slot or aperture and a stepped-down leading edge or toe, wherein each of said first and second flukes has a lateral extension protruding from the free edge thereof at an angle thereto and out of the plane thereof, and wherein each respective lateral extension is connected along an edge to said rear extension.

2. The anchor as claimed in claim 1, wherein said lateral extension extends along at least part of the free edge of the associated fluke, with free edges of said extensions being of a shape other than blunt.

3. The anchor as claimed in claim 2, wherein said rear extension depends at an angle rearwardly of said base member, with free edges thereof being of a shape other than blunt.

4. The anchor as claimed in claim 3, wherein said shank member is in the form of an elongate member, affixed to said base member and extending substantially normal thereto, said elongate member being of a progressively reducing thickness dimension along the length thereof.

5. The anchor as claimed in claim 4, wherein said shank member includes, at or in the vicinity of the location of joining thereof to said base member, a discontinuity or shoulder.

6. The anchor as claimed in claim 5, wherein said shank member is substantially arcuate in shape.

7. The anchor as claimed in claim 6, wherein each fluke has a stepped-down leading edge.

8. The anchor as claimed in claim 4, wherein the uppermost edge or surface of said elongate member is of a shape other than blunt, said elongate member being of a substantially arcuate configuration.

9. The anchor as claimed in claim 8 wherein said elongate member includes, at or in the vicinity of the free end thereof, at least one aperture, adapted to receive and releasably retain a chain, cable or rope for/of said anchor.

10. The anchor as claimed in claim 1, including one or more discontinuities, holes, slots or apertures extending through each said fluke.

11. The anchor as claimed in claim 10, wherein at least one discontinuity, hole, slot or aperture in said fluke extends into an adjacent lateral extension or an adjacent rear extension.

* * * * *